US007571838B2

(12) United States Patent
Wolter et al.

(10) Patent No.: US 7,571,838 B2
(45) Date of Patent: Aug. 11, 2009

(54) DOSING DEVICE WITH A DOSING CASING IN ONE OR MORE PARTS

(75) Inventors: Michael Wolter, Taegerwillen (CH); Thomas Bruder, Constance (DE); Volker Goebel, Constance (DE); Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 476 days.

(21) Appl. No.: 10/938,065

(22) Filed: Sep. 10, 2004

(65) Prior Publication Data

US 2005/0056664 A1 Mar. 17, 2005

(30) Foreign Application Priority Data

Sep. 11, 2003 (DE) ..... 103 43 329

(51) Int. Cl.
*B67D 5/42* (2006.01)

(52) U.S. Cl. ..... 222/391; 222/320

(58) Field of Classification Search ... 222/321.7–321.9, 222/391, 541.5, 541.6, 320, 321.1, 321.3, 222/541.1, 319, 386, 383.1; 239/491–496
See application file for complete search history.

(56) References Cited

U.S. PATENT DOCUMENTS 3,161,325 A * 12/1964 Hinkel et al. ..... 222/80
3,204,835 A * 9/1965 Michel ..... 222/541.5
3,379,381 A * 4/1968 Decaux ..... 239/333
3,437,270 A * 4/1969 Venus, Jr. ..... 239/118
4,187,985 A * 2/1980 Goth ..... 239/337
4,251,032 A * 2/1981 Werding ..... 239/323
4,323,176 A * 4/1982 Sartain ..... 222/326
4,360,156 A * 11/1982 Soth et al. ..... 239/11
4,779,770 A * 10/1988 Herold ..... 222/391
5,647,515 A * 7/1997 Zwijnenberg et al. ..... 222/389
5,897,009 A * 4/1999 O'Meara ..... 215/253
6,419,124 B1 * 7/2002 Hennemann et al. ..... 222/321.6
6,419,167 B1 * 7/2002 Fuchs ..... 239/323
6,478,196 B2 * 11/2002 Fuchs ..... 222/321.6
6,543,703 B2 * 4/2003 Blake ..... 239/106
6,626,379 B1 9/2003 Ritsche et al.
2003/0127472 A1 * 7/2003 Doherty et al. ..... 222/541.5
2004/0245291 A1 * 12/2004 Simon et al. ..... 222/321.7
2005/0139615 A1 * 6/2005 Stradella et al. ..... 222/321.8

FOREIGN PATENT DOCUMENTS

DE 197 49 514 11/1997

* cited by examiner

*Primary Examiner*—Lien T Ngo
(74) *Attorney, Agent, or Firm*—Flynn, Thiel, Boutell & Tanis, P.C.

(57) ABSTRACT

A dosing device includes a dosing casing in one or more parts and with which are associated a pumping unit and a manually operable actuating unit, in which the dosing casing includes at least one dosing opening. The dosing casing has a jacket enveloping the pumping unit and on which is integrally shaped at least one actuating member mounted in elastically pivotable manner between a rest position and an actuating position.

1 Claim, 4 Drawing Sheets

DOSING DEVICE WITH A DOSING CASING IN ONE OR MORE PARTS

The following disclosure is based on German Patent Application No. 10343329.5 filed on Sep. 11, 2003, which is herewith incorporated into this application by explicit reference.

BACKGROUND FOR THE INVENTION

The invention relates to a dosing device with a dosing casing in one or more parts with which are associated a pumping unit and a manually operatable actuating unit, the dosing casing including at least one dosing opening.

Such dosing devices for the discharge of pharmaceutical or cosmetic media are generally known. Such a dosing device has a dosing casing made from a plastics material. The dosing casing includes a screw cap, which can be screwed onto a medium container. A pumping unit is concentrically located within the dosing casing and is constructed as a mechanically operable thrust piston pump. For the actuation of the thrust piston pump an actuating unit is provided, which is connected to the stroke-movable part of the pumping unit and includes a finger support or rest for a manual operation of the pumping unit. The dosing casing is provided with an application extension, particularly in the form of a spraying head or nose olive. The application extension, which is part of the dosing casing, contains at least one dosing opening by means of which the in particularly liquid medium can be discharged into the environment by the pumping unit via at least one discharge channel.

It is also known (DE 197 49 514 A1) to provide a dosing device in the form of a disposable dosing means with a dosing casing, which essentially comprises the application extension in the form of a nose olive and a finger rest shaped onto the application extension. The dosing casing has a receptacle for the stroke-movable retention of a medium reservoir in the form of an ampoule. The ampoule is part of the pumping unit. Through pressure by means of a thumb and simultaneous counterholding of the dosing casing using the index and middle fingers in the vicinity of the finger rest, the ampoule is pressed into the casing, so that a perforating needle perforates a sealing piston within the ampoule and releases the outflow of the medium into a discharge channel and to a dosing opening in a upper front area of the nose olive.

The problem of the invention is to provide a dosing device of the aforementioned type permitting a good medium discharge using simple means.

SUMMARY OF THE INVENTION

This problem is solved in that the dosing casing has a jacket enveloping the pumping unit on which is elastically integrally shaped at least one actuating member elastically pivotably mounted between a rest position and an actuating position. The jacket firstly forms an envelope for the dosing device and secondly locates the actuating member. The integral shaping of the actuating member allows an extremely simple construction of the dosing device with few components. Preferably, the dosing casing including the jacket and the actuating member are made from plastic. As a result the dosing devices can be inexpensively manufactured in large numbers.

According to a development of the invention the dosing opening is associated with an application extension of the dosing casing and onto the application extension is drawn a cap of elastic hose material, which is provided with the dosing opening. The cap is drawn on under tension and is consequently essentially frictionally held on the application extension. As the cap is a separate component it is possible to provide different types of dosing openings for different caps, so that the in each case suitable cap can be drawn into module-like manner onto the application extension.

According to a further development of the invention the application extension is provided with at least zonally externally positioned flow guidance surfaces and at least in a partial section the cap is constructed as a hose valve cooperating with the flow guidance surfaces. Therefore the cap has a double function because, apart from the dosing or discharge characteristic, it also has a valve function.

According to a further development of the invention the elastic cap has at least one ring profiling, which in the fitted state positively cooperates with a corresponding ring profiling of the application extension. This ring profiling prevents the cap in the case of pressurization of the pumping unit and particularly when it is functioning as a hose valve from becoming detached from the application extension or changing its position on the application extension.

According to a further development of the invention the actuating member is mounted in lever-like manner on the jacket and has on its free front end region a thrust element in operative connection with a linear guidance part of the pumping unit during an actuating stroke. As a result a pivoting movement of the actuating member becomes an actuating stroke of the pumping unit. In particularly advantageous manner the thrust element is integrally shaped on the actuating member, which leads to a further simplification of dosing device manufacture.

According to a further development of the invention with the thrust element is associated a support element, which mechanically stabilizes the thrust element in the case of action on the linear guidance part. This ensures that there is a precise stroke dosing during actuation of the lever-like actuating member. The support element prevents elastic deformations, particularly bending of the thrust element.

According to a further development of the invention the support element is integrally shaped onto the actuating member. Thus, with particularly simple means, there is a reliable stabilization of the thrust element when the actuating member is moved.

According to a further development of the invention the support element is spaced from the thrust element and constructed as a boundary stop for an elastic deformation of the thrust element. The support element supports and stabilizes the thrust element in such a way that there is a reliable, constant operative connection to the linear guidance part of the pumping unit.

According to a further development of the invention a hemispherical dosing chamber is provided in an application extension of the dosing casing and is provided with several flow guidance profilings in its wall area issuing at the dosing opening, and the dosing chamber is provided with a spherical filler, which is matched to the hemispherical shape of the dosing chamber. This makes it possible to bring about a particularly good flow guidance for the medium to be discharged.

According to a further development of the invention the application extension of the dosing casing is provided a tear-off cap shaped in the vicinity of the dosing opening and which in the torn-off state serves as a closure cap for the application extension and the dosing opening. Consequently the tear-off cap has a double function, because in the not yet torn-off original state it closes the dosing opening and also in the torn-off state can be placed on the application extension in such a way that the dosing opening is sealed. The tear-off cap is preferably provided on its side opposite to the tear-off nipple with an open cavity, which is matched to the outer contour of the application extension and in this way allows a non-positive pressing of the tear-off cap onto the application extension.

According to a further development of the invention the actuating member is in the form of an actuating tab or lug, which is integrated in flush manner into the envelope surface of the jacket and is cut free by slits in the jacket for pivoting movement. Thus, in an esthetically pleasing, space-saving manner an actuating function for the dosing device is obtained. Preferably the two actuating lugs are integrated into the jacket on opposite sides thereof.

BRIEF DESCRIPTION OF THE DRAWINGS

Further advantages and features of the invention can be gathered from the claims and the following description of preferred embodiments of the invention relative to the attached drawings, wherein show:

DETAILED DESCRIPTION OF THE INVENTION

Figure 1:
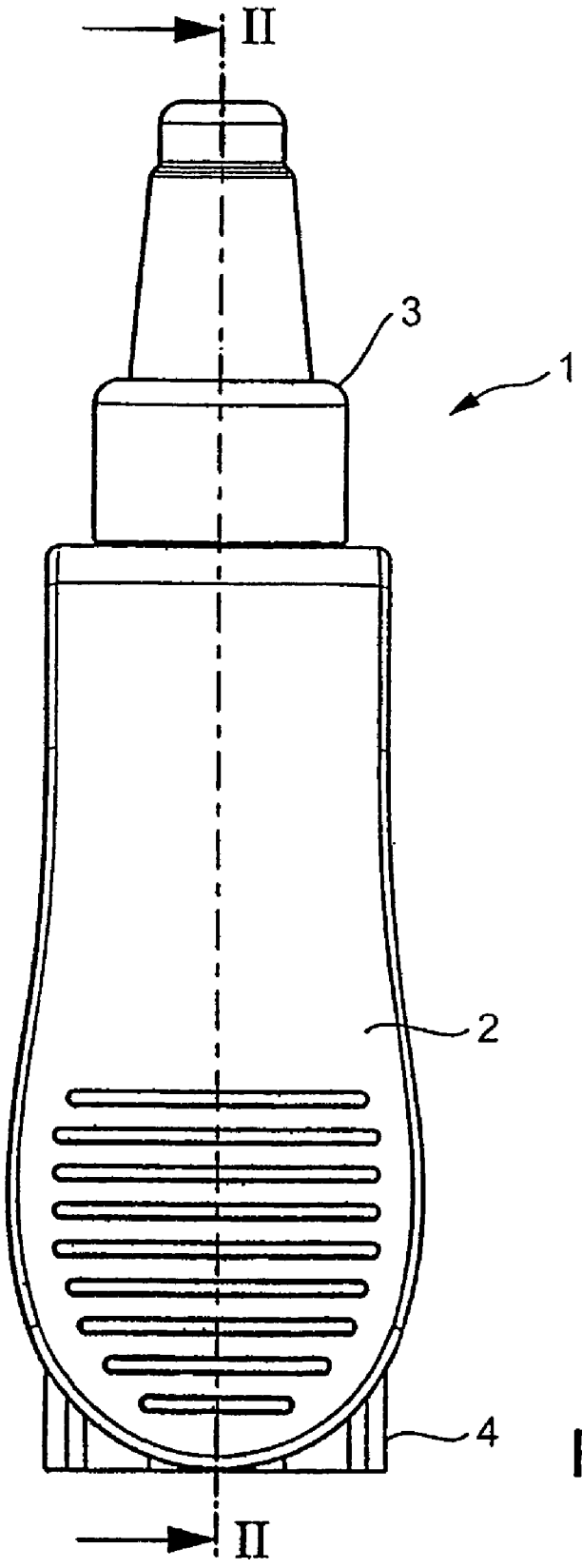
FIG. 1 In a side view an embodiment of a dosing device according to the invention.
Figure 2:
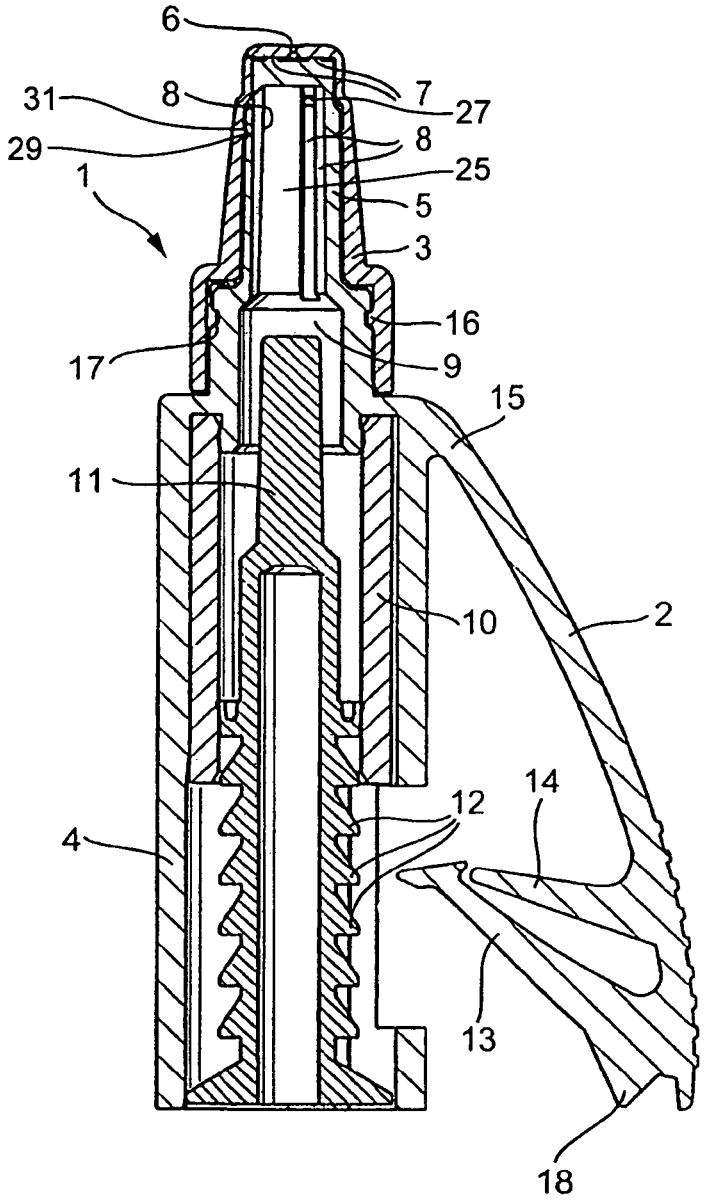
FIG. 2 The dosing device according to FIG. 1 in a sectional representation along section line II-II in FIG. 1.
Figure 3:
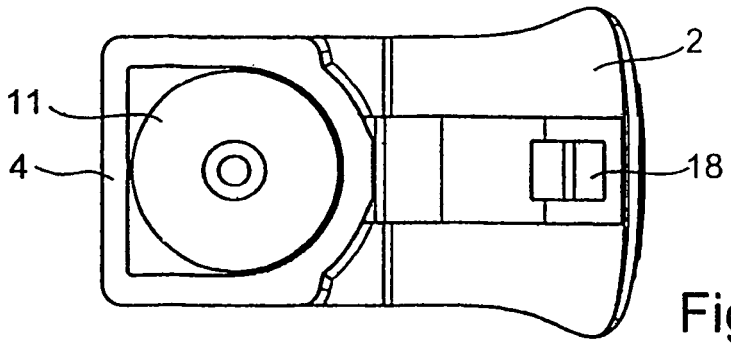
FIG. 3A view from below of the dosing device of FIGS. 1 and 2.

A dosing device 1 according to FIGS. 1 to 3 is provided for the discharge of cosmetic media. However, in the same way such a dosing device can also be used for pharmaceutical purposes. The dosing device has a dosing casing 4, 5, 10, which is provided in an upper area with an application extension 5. The dosing casing 4, 5 has an envelope-like jacket 4 on which, in a manner to be described in greater detail hereinafter, is integrally shaped a lever-like actuating member 2. The actuating member 2 is mounted in elastically pivotable manner by means of a solid state joint 15 on the dosing casing 4, 5, i.e. on the jacket 4.

The dosing casing 4, 5 contains a pumping unit 10 to 12 coaxial to a median longitudinal axis of the dosing device 1 and which is constructed as a thrust piston pump. The pumping unit has a hollow cylindrical portion 10 firmly connected with the dosing casing 4, 5 and in particular the jacket 4 and in the same is linearly movably displaceably arranged a piston section 11. The piston section 11 is movable within a dosing chamber 9 of the dosing casing 4, 5 and is provided in its rear area projecting out of the dosing chamber 9 with a linear guidance part 12, which has step-like profilings for gradual linear movement of the piston section 11.

The application extension 5 is hollow and on the inside forms an application chamber area. The dosing chamber 9 passes in open form into said application chamber area 25. The application chamber area 25 contains flow guidance profilings 8, which are oriented along the stroke direction of the piston section 11. In an upper area of the application extension 5 the inner flow guidance profilings 8 within the application chamber 25 are provided with openings 27 to the outside of the application extension 5. The flow axes of these openings are oriented with a radial component to the stroke axis of the piston section 11. In an upper end face region the application extension 5 has a substantially planar surface oriented in a radial plane relative to the stroke axis of the piston section 11. Web-like flow guidance faces 7 are provided on the front end region of the application extension 5.

Onto the application extension 5 is drawn a cap 3 made from an elastic plastics material, which extends in hood-like manner over the entire application extension 5 and terminates at a not further designated collar section of the jacket 4. In the front end region of the application extension 5 the elastic cap has a relatively small material thickness, which continuously increases downwards towards the jacket 4. With the increase of the material thickness there is a reduction of the elastic resilience of the cap 3. By means of an inner annular shoulder 16 the cap is axially positively held in a corresponding annular groove 17 on the application extension 5. Tn addition, the cap 3 is drawn under elastic tension onto the application extension 5. In its thin-walled front cap region resting on the front end region of the application extension 5, the cap 3 is provided with a dosing opening 6 constructed as a spraying nozzle. In the thin-walled, upper front cap region a jacket section of the cap 3 is designed in thin-walled form and provided with an annular step. The outwardly leading openings 27 of the flow guidance profilings 8 of the application extension 5 are provided level with the step. The wall thickness of the front cap region and in particular the jacket section of cap 3 is so thin that in the case of a liquid medium flowing out under pressure in the vicinity of the openings of the flow guidance profilings 8 the jacket section of the cap 3 widens in the manner of a hose valve, so that the liquid medium can flow to the flow guidance faces 7 and to the dosing opening 6 in the vicinity of the outside of the application extension 5. Just below the outwardly leading openings in the application extension 5, the cap 3 has a sealing collar 29, which brings about a downward sealing action by means of an engagement in a corresponding annular groove 31 on the outer circumference of the application extension 5. The medium flowing out through the openings can consequently only be fed upwards to the dosing opening 6. The flow guidance faces 7 and dosing opening 6 are matched to one another in such a way that the medium flow is subject to a twisting movement and is atomized at the dosing opening 6. Consequently the dosing opening 6 is an atomizing opening.

To bring about a pumping movement of the piston section 11, the lug-like outwardly and downwardly sloping, projecting actuating member 2 is provided with a web-like thrust element 13, which is integrally shaped in a lower end region of the actuating member 2 and when the latter is in the unloaded state projects upwards and inwards under an acute angle to the stroke axis of the piston section 11. At its inner front end region the thrust element 13 has a cam section, which is provided for engagement in sawtooth-like profilings 12 of the linear guidance part. At the front end region of the thrust element 13 the cam section projects towards the linear guidance part. In diametrically facing manner the front end region of the thrust element 13 is provided with a not specifically designated support shoe, which projects in nose-like manner towards the actuating member 2. With said nose-like support shoe cooperates a support element 14, which is integrally shaped onto the actuating member 2 above the thrust element 13. Relative to the unloaded state of the actuating member 2, the support element 14 also projects under an acute angle inwards towards the stroke axis of the piston section 11. With its inner front region the support element 14 is positioned in the immediate vicinity of the support shoe of thrust element 13. In accordance with FIG. 2, in the unloaded state the thrust element 13 and support element 14 project towards one another under an acute angle. The support element 14 serves to prevent a moving aside of the thrust element 13 on engagement in the sawtooth-like profilings 12 of the linear guidance part. The support element 14 consequently stabilizes the thrust element 13 during engagement in one of the profilings 12 of the linear guidance part.

In order to perform an actuating stroke for the dosing device 1, the actuating member 2 is forced from its unloaded starting position shown in FIG. 2 by the fingers of one hand towards the jacket 4 and consequently inwards. The support cam of the thrust element 13 engages with one of the sawtooth-like profilings 12 of the linear guidance part. During a further inward pivoting of the actuating member 2, on the linear guidance part is necessarily exerted an upward stroke movement. In order to ensure that the support cam of the thrust element 13 does not slide out of the corresponding profiling 12 again, for stabilizing the locked or hooked in thrust position of the thrust element 13, i.e. of the support cam, the support element 14 is provided, which in the depressed state of the actuating member 2 as a result of a certain elastic deformation of the thrust element and the actuating member 2 engages behind the support shoe in stabilizing manner. As soon as the compressive force on the actuating member 2 is removed, the elastic tension of the actuating member 2 brings about a return to the starting position shown in FIG. 2. Therefore the support cam is again disengaged from the linear guidance part. The linear guidance part and therefore also the piston section 11 remain in the stroke position set during the actuating process. Since a stroke movement of the piston section 11 has brought about a compression of the liquid medium within the dosing chamber 9, necessarily during such a stroke movement liquid medium is pumped outwards through the openings 27 in the vicinity of the application extension 5 and via the dosing opening 6 is sprayed into the environment. On removing the compressive force on the actuating member 2 the piston section 11 then remains in the set pressure equilibrium position. Only a further actuation of the actuating member 2 leads to a further stroke process of the piston section 11 and consequently to a further dosing discharge.

In a lower area of the thrust element 13 is integrally shaped a stop extension 18, which on the one hand forms an end stop for the actuating member 2 and on the other a bearing surface for a reliable placement of the dosing device 1 in the upright state in addition to the standing surface in the vicinity of a bottom of the jacket 4.

Figure 4:
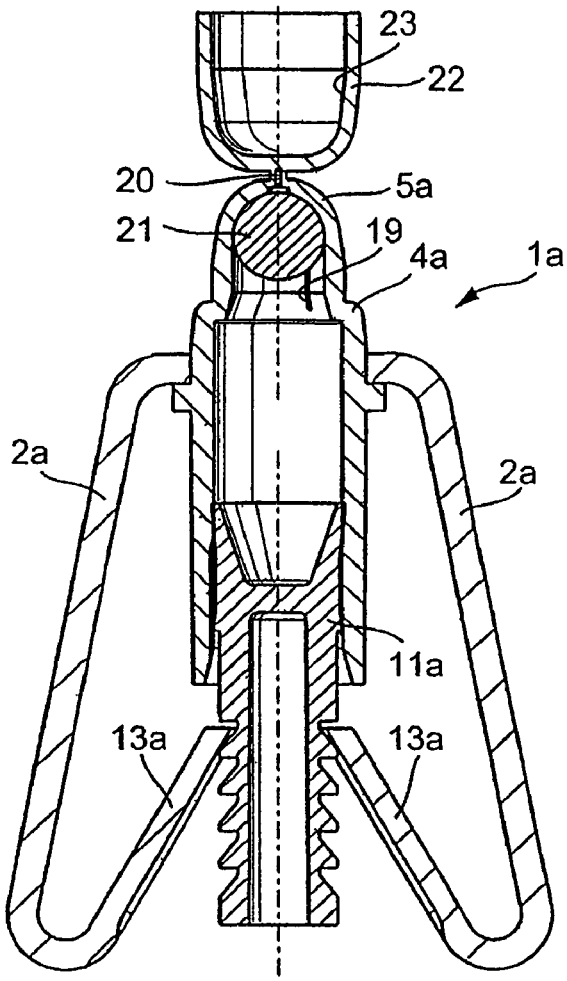
FIG. 4 In a sectional representation another embodiment of a dosing device according to the invention.
Figure 5:
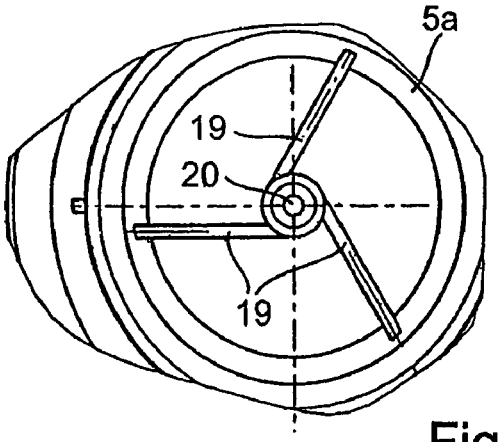
FIG. 5 On a larger scale a view from below of a front region of a dosing casing of the dosing device according to FIG. 4 level with a dosing opening.
Figure 6:
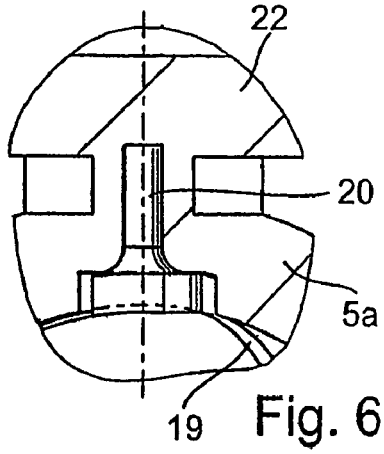
FIG. 6 A larger scale sectional representation of a detail of the front region of the dosing casing level with the dosing opening.

In the embodiment according to FIGS. 4 to 6 the dosing device 1*a* has two diametrically facing, wing-like actuating members 2*a*, which are in each case provided with inwardly and upwardly sloping, projecting thrust elements 13*a*. The two actuating members 2*a* project integrally from a not further specified torus, which rests on a collar of a dosing casing 4*a*. The torus forms a jacket in the sense of the invention. In its interior the dosing casing 4*a* forms a substantially cylindrical dosing chamber in which is displaceably positioned a pumping unit piston 1*a*. In its end region remote from the dosing chamber, the piston 11*a* has sawtooth-like profilings belonging to a linear guidance part. In accordance with the embodiment of FIGS. 1 to 3, the actuating members 2*a* are arranged in elastically pivotable manner by means of in each case a solid state joint on the torus and therefore relative to the dosing casing 4*a*. Compressive loading from the outside on the actuating members 2*a*, via the thrust elements 13*a* and as in the previously described embodiment, brings about a stroke movement of the piston 11*a*. Preferably the compressive loading on both actuating members 2*a* takes place simultaneously and uniformly, so that both thrust elements 13*a* simultaneously exert the same compressive loads in the stroke direction on piston 1I a. During a subsequent load relief the actuating members 2*a* move back into their unloaded starting position, so that the thrust elements 13*a* are necessarily moved relative to the linear guidance part in the direction of further downwardly positioned profilings. When loading is again exerted on the actuating members 2*a*, the thrust elements 13*a* engage on the corresponding, further downwardly positioned, sawtooth-like profilings.

In an upper area the dosing casing 4*a* is provided with an application extension 5*a* surrounding a hemispherical application chamber. In the wall of the application chamber are provided three flow guidance profilings in the form of flow grooves 19, which issue tangentially into an annular dosing opening and consequently impart a twist. The application chamber is filled by a spherical filler 21, which is matched to the application chamber dimensions in such a way that the filler 21 is held under force fit within said application chamber (FIG. 4). Thus, the liquid medium from the dosing chamber can only be fed via the flow grooves 19 past the filler 21 to the dosing opening 20. The dosing opening 20 is constructed as a spraying nozzle, so that with the aid of the twist imparting functions of the opening areas of the flow grooves 19, there is a good atomization of the liquid medium on passing to the outside. The dosing device 1*a* is more particularly provided for cosmetic purposes.

In the unused state the dosing opening 20 is closed by a tear-off cap 22, which has a hat-like construction and consequently, in the injection moulded-on state, forms an upwardly open hollow chamber 23. The hollow chamber 23 is matched to the outer contour of the application extension 5*a*, so that, after tearing off, the tear-off cap 22 in the turned round state can be engaged on the application extension 5*a* and consequently brings about a releasable closure of the dosing opening 20.

Figure 7:
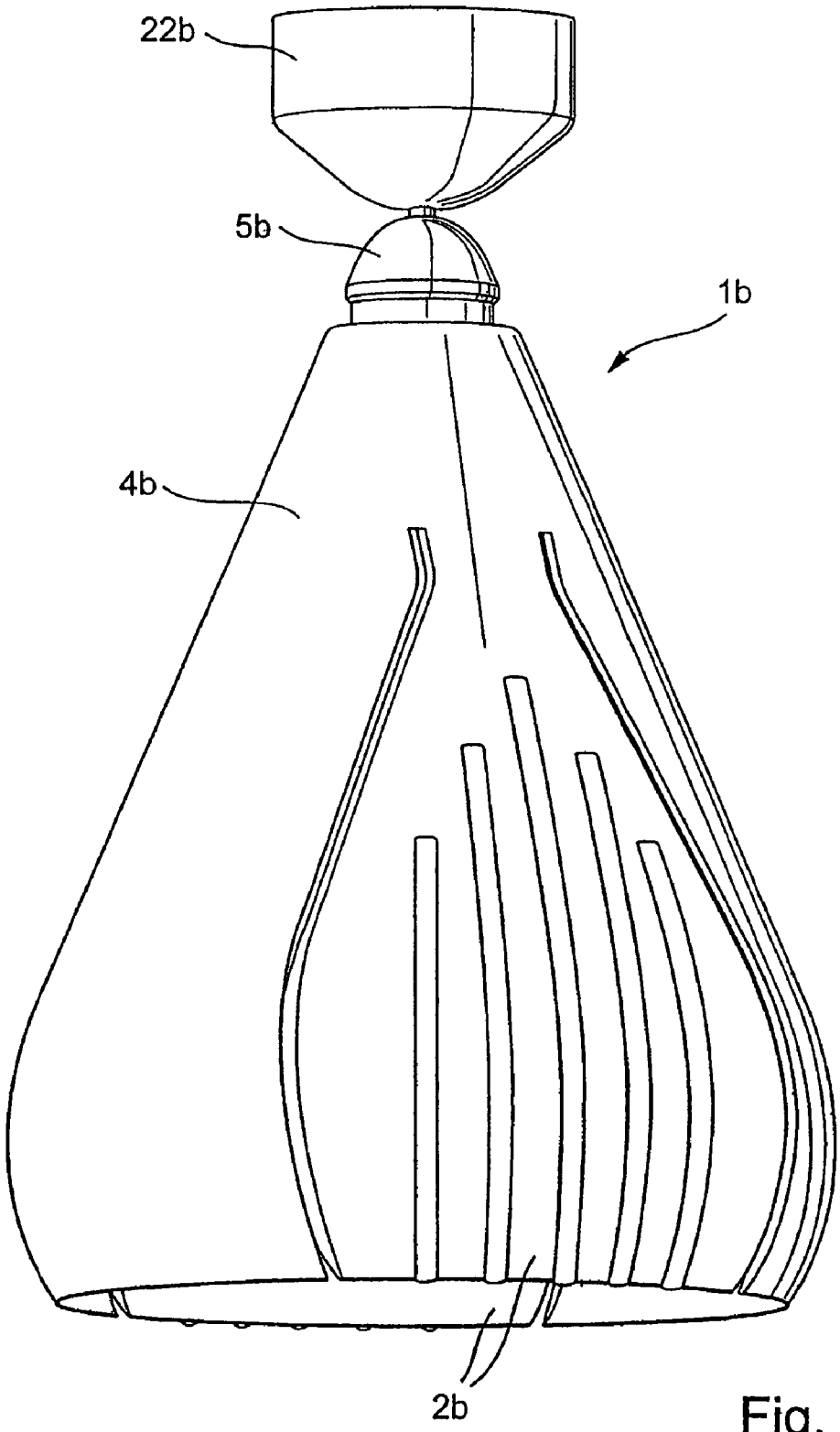
FIG. 7 A perspective view of a further embodiment of a dosing device according to the invention.

In the embodiment according to FIG. 7 the dosing device 1*b* has an application extension 5*b*, which is also provided with an injection moulded-on tear-off cap 22*b*. After tearing off the tear-off cap 22*b*, when the latter is turned round it can be engaged as a releasable closure on the application extension 5*b*. In the embodiment according to FIG. 7*a* jacket 4*b* of the dosing casing of the dosing device 1*b* is given a pear-shaped or conical design and constructed as a rotationally symmetrical hollow body. The medium reservoir and pumping unit are located within the jacket 4*b*. In diametrically facing manner, the jacket 4*b* has two lug-like actuating members 2*b*, which are integrated flush into the contour of the jacket 4*b* and are otherwise constructed integrally with the jacket 4*b*. The mobility of the lug-like actuating members 2*b* is brought about in that each actuating member 2*b* is cut free by in each case two slits, which are open to a lower marginal area of the jacket 4*b*. In the manner shown in FIG. 4, both actuating members 2*b* have inside thrust elements, which are in operative connection with a corresponding linear guidance part of the pumping unit. With regards to the actuating and dosing function for the embodiment of FIG. 7 reference is made to the description of the embodiment according to FIGS. 4 to 6.

The invention claimed is:

1. Dosing device with a dosing casing in one or more parts, with which are associated a pumping unit for a medium and a manually operable actuating unit, the dosing casing including at least one dosing opening, wherein the dosing opening is associated with an application extension of the dosing casing protruding from a base part of the dosing casing and having a hollow application chamber inside, onto which is drawn a cap made from an elastic plastics material, said cap having a sealing collar to engage with an outer circumference of the application extension, said cap further being provided with the dosing opening, wherein an outwardly leading opening is provided connecting the application chamber to the outside of the application extension, said opening ending between the outer circumference of the application extension and the cap, wherein the application extension is provided with at least zonally externally positioned flow guidance faces, and wherein the cap, at least in a partial section, is constructed as a hose valve cooperating with the flow guidance faces, said hose valve closing said dosing opening until the medium is pressurized by the pumping unit.

* * * * *